US008470106B2

(12) United States Patent
Cloue et al.

(10) Patent No.: US 8,470,106 B2
(45) Date of Patent: Jun. 25, 2013

(54) METHOD OF HEAT TREATMENT FOR DESENSITIZING A NICKEL-BASED ALLOY RELATIVE TO ENVIRONMENTALLY-ASSISTED CRACKING, IN PARTICULAR FOR A NUCLEAR REACTOR FUEL ASSEMBLY AND FOR A NUCLEAR REACTOR, AND A PART MADE OF THE ALLOY AND SUBJECTED TO THE TREATMENT

(75) Inventors: Jean-Marc Cloue, Nuelles (FR); Veronique Garat, Caluire (FR); Eric Andrieu, Verfeil (FR); Julien Deleume, Albertville (FR)

(73) Assignee: Areva NP, Courbevoie (FR)

( * ) Notice: Subject to any disclaimer, the term of this patent is extended or adjusted under 35 U.S.C. 154(b) by 719 days.

(21) Appl. No.: 12/448,588

(22) PCT Filed: Dec. 6, 2007

(86) PCT No.: PCT/FR2007/002006

§ 371 (c)(1),
(2), (4) Date: Jun. 25, 2009

(87) PCT Pub. No.: WO2008/081118

PCT Pub. Date: Jul. 10, 2008

(65) Prior Publication Data

US 2010/0116383 A1 May 13, 2010

(30) Foreign Application Priority Data

Dec. 29, 2006 (FR) ..... 06 11538

(51) Int. Cl.
*C22F 1/10* (2006.01)
*C22C 19/05* (2006.01)

(52) U.S. Cl.
USPC ..... 148/675; 148/427; 148/428

(58) Field of Classification Search
USPC ..... 148/675, 427, 428
See application file for complete search history.

(56) References Cited

U.S. PATENT DOCUMENTS

| | | | | |
|---|---|---|---|---|
| 3,368,883 | A * | 2/1968 | Barnett et al. | 75/229 |
| 5,047,093 | A | 9/1991 | Kimmerle et al. | |
| 5,164,270 | A | 11/1992 | Natesan | |
| 5,244,515 | A | 9/1993 | Miglin | |
| 6,482,528 | B2 * | 11/2002 | Anada et al. | 428/472 |
| 2002/0006524 | A1 | 1/2002 | Jaslier et al. | |

FOREIGN PATENT DOCUMENTS

| | | |
|---|---|---|
| EP | 0860507 | 8/1998 |
| JP | A 2000 053 492 | 2/2000 |
| WO | WO 9424320 | 10/1994 |

OTHER PUBLICATIONS

Smialek J L, "*Oxidation Resistance and Critical Sulfur Content of Single Crystal Superalloys*", Journals of Engineering for Gas Turbines and Power, Apr. 1998, pp. 370-374, vol. 120 , No. 2, Asme, New York, NY US.

Smialek J L et al. , "*Effects of Hydrogen Annealing, Sulfur Segregation and Diffusion on the Cyclic Oxidation Resistance of Superalloys: A Review*", Dec. 15, 1994, pp. 285-292, vol. 253, No. 1/2, Thin Solid Films, Elsevier-Sequoia S. A. Lausanne.

Liu L et al., "*Study of the Effect of Delta Phase on Hydrogen Embrittlement of Inconel 718 by Notch Tensile Tests*", Corrosion Science, Feb. 2005, pp. 355-367, vol. 47, No. 2, Oxford, GB.

* cited by examiner

*Primary Examiner* — Jessee R. Roe

(74) *Attorney, Agent, or Firm* — Davidson, Davidson & Kappel, LLC

(57) ABSTRACT

A heat treatment method for desensitizing a nickel-based alloy with respect to environmentally-assisted cracking, the alloy having the following composition in percentages by weight: C≦0.10%; Mn≦0.5%; Si≦0.5%; P≦0.015%; S≦0.015%; Ni≧40%; Cr=12%-40%; Co≦10%; Al≦5%; Mo=0.1%-15%; Ti≦5%; B≦0.01%; Cu≦5%; W=0.1%-15%; Nb=0-10%; Ta≦10%; the balance being Fe, and inevitable impurities that result from processing, characterized in that the alloy is held at 950° C.-1160° C. in an atmosphere of pure hydrogen or containing at least 100 ppm of hydrogen mixed with an inert gas. A part made of a nickel-based alloy having the composition and that has been subjected to the heat treatment.

20 Claims, No Drawings

METHOD OF HEAT TREATMENT FOR DESENSITIZING A NICKEL-BASED ALLOY RELATIVE TO ENVIRONMENTALLY-ASSISTED CRACKING, IN PARTICULAR FOR A NUCLEAR REACTOR FUEL ASSEMBLY AND FOR A NUCLEAR REACTOR, AND A PART MADE OF THE ALLOY AND SUBJECTED TO THE TREATMENT

The invention relates to the metallurgy of nickel-based alloys, and more particularly to the alloys used for fabricating structural components for nuclear reactors or for fuel assemblies inserted in the reactors.

BACKGROUND

Certain components of nuclear reactors, such as heat exchangers, cluster guide pins, pipework, fasteners for fastening components made of steel and used for making the cooling circuits of light water nuclear reactors or of nuclear reactors having a heat-conveying fluid in the form of a gas or a molten salt or a liquid metal, are made out of nickel-based alloys, e.g., out of various types of Inconel®. At high temperature and at high pressure, such components need to present good resistance to oxidation, to corrosion, to creep, and to cyclical stresses both thermal and mechanical, and they need to do so for long periods of time (several tens of years), and nickel-based alloys are well adapted to such purposes.

Fuel assemblies for light water nuclear reactors may also have some of their structural components made of a nickel-based alloy, with the 718 alloy being a preferred example. This applies in particular to grid springs that are usually fabricated from strips of such alloys, and hold-down springs made either from flat half-finished products for spring blades, or from wires for coil springs, and also fastener elements, that are made from bars.

The nickel-based alloys that can be used in these contexts have the following general composition, expressed in percentages by weight: C≦0.10%; Mn≦0.5%; Si≦0.5%; P≦0.015%; S≦0.015%; Ni≧40%; Cr=12%-40%; Co≦10%; Al≦5%; Mo=0.1%-15%; Ti≦5%; B≦0.01%; Cu≦5%; W=0.1%-15%; Nb=0-10%; Ta≦10%; the balance being Fe and inevitable impurities that result from processing. Those elements for which a minimum value is not given may be completely absent, or present solely as traces. There may also be small amounts of other elements that are used more rarely, for the purpose of adjusting certain chemical or mechanical properties, and that do not radically change the behavior of the alloy in terms of its sensitivity to environmentally-assisted cracking, which in an aqueous medium gives rise to a phenomenon of corrosion under stress.

Typically, the composition of 718 alloy, a particular example of such alloys, is as follows: C≦0.08%; Mn≦0.35%; Si≦0.35%; P≦0.015%; S≦0.015%; Ni=50%-55%; Cr=17%-21%; Co≦1%; Al=0.2%-0.8%; Mo=2.8%-3.3%; Ti=0.65%-1.15%; B≦0.006%; Cu≦0.3%; Nb+Ta=4.75%-5.5%; the balance being Fe and inevitable impurities that result from processing. It may also contain a few hundreds of parts per million (ppm) of Mg.

A problem that is of increasing importance in the operation of reactors containing such components is the ability of the components to withstand environmentally-assisted cracking. Firstly, it is desirable to lengthen as much as possible the durations of operating cycles for fuel assemblies. Thus, it is desirable to lengthen the present usual duration of 12 months to 18 months or even 24 months. Secondly, the conditions specific to the primary medium in light water reactors (LWR) are favorable to the development of environmentally-assisted cracking. The same applies to reactors in which the heat-conveying fluid is gas or molten salt or liquid metal, given the very high temperatures that are reached, which exacerbate oxidation phenomena. Experience with pressurized water reactors has shown in particular that grid springs made of 718 alloy can fracture while in use as a result of a process of environmentally-assisted cracking, specifically stress corrosion cracking (SCC). Fractures or cracks have also been found in cluster guide pins made of X750 alloy, in the pipework of steam generators made of 600 alloy, in the bottom-of-vessel bushings, and in welded zones, all of these parts being made of various grades of nickel-based alloy.

To improve the reliability of nickel-based alloy components, in particular components of 718 alloy, it is therefore necessary to find means for reducing the sensitivity of such components to environmentally-assisted cracking.

Until now, the solutions used have, above all, involved good industrial practice or palliative measure.

Thus, proposals have been made to modify the surface state of a structural element either mechanically (shot blasting, microbeading, sand blasting, . . . ) or chemically (electropolishing). For example, document JP-A-2000 053 492 teaches removing the outermost surface layer of a monocrystalline cast material of Ni-based superalloy by oxidizing the layer and then by performing electrochemical polishing. After that, heat treatment at a temperature equal to or greater than the recrystallization temperature is performed. That eliminates residual surface stresses in the material that make it sensitive to environmentally-assisted cracking. The surface is then covered in a ceramic layer. That document teaches applying that method to gas turbine blades, however the modification to the surface state of the material for eliminating residual stress has also been performed on the tubes of steam generators that are made of 600 and 690 alloys.

Another method consists of applying a suitable coating on the materials. Thus, it is common to nickel-plate 718 alloy grid springs in order to reduce the number of spring fractures in service. Other types of coatings, e.g. surface treatment by diffusion, are also possible. Thus, document U.S. Pat. No. 5,164,270 proposes implanting Nb and/or Zr in the surface of a ferrous alloy having 9% to 30% Cr, and exposing it to a gaseous mixture of $O_2$ and S. That could also be applied to an Ni-based alloy.

Another solution consists in performing overall or local heat treatment at high temperature (1100° C.) on the structural elements, leading to changes in the microstructure of the material. Local treatment is thus performed on the bends of 600 alloy steam generators. Attempts have also made in that way to eliminate all traces of δ phase in 718 alloy (see document U.S. Pat. No. 5,047,093).

Another solution consists of modifying the chemical composition of the material in more or less radical manner, which can sometimes lead to developing new alloy grades. Thus, 600 alloy has been replaced by 690 alloy in the manufacture of steam generator tubes. That approach is expensive in research and development time, and it does not always lead to results that are technically and/or economically viable for industrial applications.

Finally, action has been taken not on the materials themselves, but on the design of the structures, seeking to reduce the stress levels to which they are subjected. That approach is likewise in any event expensive in development time and often leads to failure.

SUMMARY OF THE INVENTION

In general, those rules of good practice tend more towards optimizing the ability of structures to withstand the stresses to which they are subjected, rather than towards improving durably and definitively the properties of the materials so as to approach their intrinsic characteristics.

An object of the invention is to provide means for improving the performance and the reliability of nuclear reactor components made of nickel-based alloy that are subjected to conditions liable to encourage environmentally-assisted cracking to appear, regardless of their design, and in particular in order to make long duration operating cycles possible. The means should also be capable of eliminating the sensitivity of the material to environmentally-assisted cracking without interfering little or not at all with the other characteristics of the material.

To this end, the invention provides a heat treatment method for desensitizing a nickel-based alloy with respect to environmentally-assisted cracking, the alloy having the following composition in percentages by weight: C≦0.10%; Mn≦0.5%; Si≦0.5%; P≦0.015%; S≦0.015%; Ni≧40%; Cr=12%-40%; Co≦10%; Al≦5%; Mo=0.1%-15%; Ti≦5%; B≦0.01%; Cu≦5%; W=0.1%-15%; Nb=0-10%; Ta≦10%; the balance being Fe and inevitable impurities that result from processing, characterized in that the alloy is held at 950° C.-1160° C. in an atmosphere of pure hydrogen or containing at least 100 ppm of hydrogen mixed with an inert gas.

The treatment for desensitization to environmentally-assisted cracking may be performed at a temperature in the range 950° C. to 1010° C.

The treatment for desensitization to environmentally-assisted cracking may be performed at a temperature in the range 1010° C. to 1160° C.

The treatment for desensitization to environmentally-assisted cracking may be performed on a half-finished product that is subsequently to be subjected to treatment to modify its metallurgical structure.

The treatment may be treatment for annealing, recrystallizing, solution heat treatment, or hardening, also called aging.

The treatment for desensitization to environmentally-assisted cracking may be performed on a product that is not subsequently subjected to treatment seeking to modify its metallurgical structure.

After desensitization to environmentally-assisted cracking, the alloy may be subjected to machining and/or polishing.

The desensitization treatment may be performed in the presence of a compound presenting greater affinity for oxygen than the alloy.

The compound is a metal such as Al, Zr, Ti, Hf, or an alloy containing at least one of those metals, or an element or a compound of elements such as Mg, Ca.

At least during the treatment for desensitization to environmentally-assisted cracking, the Ni-based alloy may be wrapped in a sheet of the metal or alloy or compound presenting greater affinity for oxygen than the Ni-based alloy.

At least during the treatment for desensitization to environmentally-assisted cracking, the Ni-based alloy may be placed in a box having one or more walls made of the metal or alloy or compound presenting greater affinity for oxygen than the Ni-based alloy.

At least during the treatment for desensitization to environmentally-assisted cracking, the Ni-based alloy may be placed in a powder of the metal or alloy or compound presenting greater affinity for oxygen than the Ni-based alloy.

The alloy may have the following composition in percentages by weight: C≦0.08%; Mn≦0.35%; Si≦0.35%; P≦0.015%; S≦0.015%; Ni=50%-55%; Cr=17%-21%; Co≦1%; Al=0.2%-0.8%; Mo=2.8%-3.3%; Ti=0.65%-1.15%; B≦0.006%; Cu≦0.3%; Nb+Ta=4.75%-5.5%; the balance being Fe and inevitable impurities that result from processing.

The invention also provides a method of fabricating a part out of a nickel-based alloy having the following composition in percentages by weight: C≦0.10%; Mn≦0.5%; Si≦0.5%; P≦0.015%; S≦0.015%; Ni≧40%; Cr=12%-40%; Co≦10%; Al≦5%; Mo=0.1%-15%; Ti≦5%; B≦0.01%; Cu≦5%; W=0.1%-15%; Nb=0-10%; Ta≦10%; the balance being Fe and inevitable impurities that result from processing, characterized in that it comprises heat treatment for desensitizing the alloy to environmentally-assisted cracking of the above type.

The invention also provides a part made of a nickel-based alloy, characterized in that the alloy has been subjected to heat treatment for desensitization to environmentally-assisted cracking of the above type.

The part may be a structural element of a nuclear reactor fuel assembly.

The part may then be a grid spring or a hold-down assembly, or a screw.

The part may then be made out of a nickel-based alloy having the following composition in percentages by weight: C≦0.08%; Mn≦0.35%; Si≦0.35%; P≦0.015%; S≦0.015%; Ni≦=50%-55%; Cr=17%-21%; Co≦1%; Al=0.2%-0.8%; Mo=2.8%-3.3%; Ti=0.65%-1.15%; B≦0.006%; Cu≦0.3%; Nb+Ta=4.75%-5.5%; the balance being Fe and inevitable impurities that result from processing.

The part may be an element of the cooling circuit of a nuclear reactor.

The part may then be a pipe, or a cluster guide pin, or a spring, or a heat exchanger, or a screw, or a bolt, or any other component made of nickel-based alloy and that comes into contact with the heat-conveying fluid.

The part may be a half-finished product from which parts can be made by a shaping, machining, or cutting method.

The part may then constitute a sheet, or a strip, or a wire, or a bar, or a blank.

DETAILED DESCRIPTION

As can be understood from the above, the invention is based firstly on developing heat treatment for the material that is performed under hydrogen or under an atmosphere containing hydrogen, then generally in the presence of a powerful reducing agent. The treatment leads to the alloy being durably desensitized relative to cracking environmentally-assisted, by means of a mechanism that is explained below.

This desensitization treatment is not a substitute for any of the heat treatments conventionally applied by the person skilled in the art to obtain looked-for mechanical characteristics, but it can be used in addition thereto.

It has been found that after subjecting a testpiece taken from a strip of 718 alloy to treatment comprising being maintained isothermally at 980° C. for 100 hours (h) in an Ar—$H_2$ (5%) gas mixture, the material that was obtained presented significantly reduced sensitivity to brittle intergranular rupture by environmentally-assisted cracking, which sensitivity could even be eliminated after polishing the outer surface of the testpiece.

This observation put the inventors on the track of an adaptation of the composition of 718 alloy and similar materials by reducing the amount of carbon, oxygen, and nitrogen, at least in the vicinity of the surfaces of parts. They were thus able to greatly reduce their sensitivity to environmentally-assisted cracking and to intergranular cracking at high temperature (>350° C.), thereby making them very well adapted to making structural elements of fuel assemblies, or of cooling circuits, that need to work under conditions in which environmentally-assisted cracking is normally likely to be a problem. This applies in particular to pressurized water reactors (PWR). However the invention is also applicable to boiling water reactors (BWR), and to reactors cooled by gas or by molten salt or by liquid metal, and also to other equipment using structural elements of nickel-based alloy operating in oxidizing conditions at medium (200° C.-500° C.) or high (500° C.-1200° C.) temperatures in a liquid or gaseous medium.

Nevertheless, if the desensitization treatment leads to a microstructure that is poorly adapted to the application, then the desensitization treatment should be combined with other heat and/or thermomechanical treatments seeking to restore to the alloy a structure and mechanical properties that make it well adapted to the intended utilizations.

The most probable mechanism for explaining cracking in Ni-based alloys by environmentally-assisted cracking in an aqueous medium, e.g. the primary fluid of a light water reactor, is as follows. It is based on intergranular diffusion of atoms of oxygen derived from dissociation of the water constituting the primary fluid. Various mechanisms can then occur at the grain boundaries that degrade their mechanical strength, and in particular:

- the formation of CO and $CO_2$ by oxidizing carbon;
- the formation of one or more embrittling oxides such as $Cr_2O_3$;
- intrinsic embrittling of grain boundaries by oxygen; and
- a release of sulfur, likewise highly embrittling, by oxygen reacting with precipitates containing sulfur, the precipitates resulting as impurities due to processing.

A similar mechanism exists with other heat-conveying fluids. Under such circumstances, the atoms of oxygen come from impurities present in the surrounding medium or from the medium itself, with the smaller quantity of oxygen being compensated by the higher operating temperature of the components made of nickel-based alloy.

Prior studies (article "Oxidation resistance and critical sulfur content of single-crystal superalloys" by J. L. Smialek, International Gas Turbine and Aeroengine Congress & Exhibition, Birmingham, 10-13 Jun. 1996) have shown that prolonged exposure (8 h to 100 h) to high temperature (1200° C.-1300° C.) in a hydrogen-containing atmosphere serves to remove sulfur from the surface of a monocrystalline nickel-based alloy by evaporation of $H_2S$. That is intended to reduce problems of the material spalling. Nevertheless, that method can be transposed as such to any Ni-based superalloy that is not monocrystalline. Under such circumstances, the high temperatures lead to grain growth and to modifications to the crystal structure that are not necessarily desired.

The inventors thus performed a first test on a testpiece taken from a strip having the following composition: C=0.016%; Ni=53.7%; B=0.0009%; Mn=0.11%; Mg=0.0087%; Mo=2.88%; Fe=18.03%; Si=0.12%; Al=0.54%; Co=0.04%; P=0.005%; Cu=0.03%; S=0.00034%; Ti=1.04%; Cr=18.1%; and Nb+Ta=5.15%; to treatment under a flow of a Ar—$H_2$ (5%) mixture with an NiCoCrAlYTa powder covering the sample to reduce the partial pressure of oxygen. The following steps were performed in succession:

- treatment at 980° C. for 100 h; that treatment serves to limit grain growth, but it leads to a δ phase being precipitated which is usually considered as being undesirable when it is desired to avoid environmentally-assisted cracking;
- putting the δ phase back into solution by spending 1 h at 1080° C., thereby also causing grains to grow; and
- hardening (aging) at 720° C. for 8 h or at 620° C. for 8 h.

After the treatment, the furnace gave off a smell of $H_2S$. Nevertheless fine analyses by light-discharge mass spectrometry did not reveal any significant drop in the amount of sulfur, but did reveal a very significant reduction in the amounts of carbon, nitrogen, and above all oxygen.

A traction test at 650° C. in air, with traction being applied at a rate of $10^{-3}s^{-1}$ gave rise to a testpiece fracture surface having a few incipient intergranular cracks, but in significantly smaller quantities than on non-treated reference samples.

Polishing each face of a testpiece identical to the preceding testpiece over 15 μm made it possible to obtain a fracture surface that was totally ductile and transgranular, by eliminating the surface zone that had not been desensitized totally.

Polishing is an optional operation. Introducing it into the desensitization process makes it possible to reduce the duration of the heat treatment.

In contrast, a testpiece treated under the above conditions, except for the absence of $H_2$ in the treatment atmosphere, and then polished, continues to present an intergranular fracture surface.

The advantages of the treatment probably stem from the highly reducing nature of the atmosphere during heat treatment, which:

- leads to oxygen, carbon, and nitrogen present in the alloy being degassed, most particularly from the grain boundaries; and
- prevents the surfaces of samples oxidizing.

This elimination of brittleness at the grain boundaries is favorable to desensitizing materials to environmentally-assisted cracking.

A program of tests was then carried out seeking to confirm the above good results and to determine the range of suitable treatments.

The samples were sheets having thickness of 0.27 mm known to present high sensitivity to environmentally-assisted cracking (cracks observed when used in a reactor).

The temperature of the desensitization heat treatment was 990° C.±10° C., to avoid austenitic grain growth and to limit δ phase precipitation.

The treatment atmosphere was Ar—$H_2$ (5%).

The samples were wrapped in sheets of an FeCrAlY alloy having the following composition: Al=5%; C=0.02%; Cr=22%; Mn=0.2%; Si=0.3%; Y=0.1%; Zr=0.01%; and Fe=the balance.

The duration of desensitization treatment was up to 100 h.

The quality of the desensitization to environmentally-assisted cracking was determined:

- by performing traction tests in air at 650° C. at a speed of the order of $10^{-3}s^{-1}$, with results in terms of fracture mode being considered as being representative of those that would be obtained under high temperature conditions in a gaseous or molten salt or liquid metal medium;
- by slow traction testing (speed of about $1.7\times10^{-8}s^{-1}$) at 350° C. in a PWR primary medium (de-aired pure water presenting a pH at 25° C. equal to 6.4, containing 2 ppm of lithium added in the form of lithine and 1200 ppm of boron added in the form of boric acid, and with a hydrogen partial pressure set at 0.5 bar with amounts of $F^-$, $Cl^-$, and $So_4^{2-}$ less than 30 parts per billion (ppb)), that were performed on V-shaped testpieces to simulate as close as possible the shape of the grid support legs which are the zones that are the most sensitive to environmentally-assisted cracking; and by slow compression tests on grid springs after desensitization.

The testpieces of 718 alloy had sections of 2×0.27 $mm^2$ or 3×0.27 $mm^2$, and had the following composition: C=0.016%; Ni=53.7%; B=0.0009%; Mn=0.11%; Mg=0.0087%; Mo=2.88%; Fe=18.03%; Si=0.12%; Al=0.54%; Co=0.04%; P=0.005%; Cu=0.03%; S=0.00034%; Ti=1.04%; Cr=18.1%; and Nb+Ta=5.15%.

They were subjected to heat treatment for desensitization to environmentally-assisted cracking by spending durations of 0 h30 to 100 h, depending on the test, at 980° C. under an atmosphere of Ar—$H_2$ (5%), followed by aging under the same atmosphere or a vacuum at 720° C. for 8 h, then at 620° C. for 8 h, in compliance with the aging treatments usually applied to the items concerned. For two reference tests, desensitization at 980° C. was not performed. For one test, covering the sample in a sheet of FeCrAlY was replaced by putting the testpiece in a box made of FeCrAlY.

After the treatment, the fractured surfaces were examined in order to determine they were intergranular (IG), transgranular (TG), or both (IG+TG).

The results are summarized in Table 1.

TABLE 1

Treatment conditions on traction test samples at 650° C. in air and at 350° C. in the PWR primary medium - results of tests

| Test | Treatment | Atmosphere | Type of fracture |
|---|---|---|---|
| 1 | 720° C./8 h + 620° C./8 h | Vacuum | Both |
| 2 | 720° C./8 h + 620° C./8 h then polish | Vacuum | Both |
| 3 | 980° C./100 h + 1080° C./1 h + 720° C./8 h + 620° C./8 h | Ar—$H_2$/vacuum | TG |
| 4 | 980° C./96 h + 720° C./8 h + 620° C./8 h | Ar—$H_2$ | TG |
| 5 | 980° C./48 h + 720° C./8 h + 620° C./8 h | Ar—$H_2$ | TG |
| 6 | 980° C./48 h + 720° C./8 h + 620° C./8 h FeCrAlY box | Ar—$H_2$ | TG |
| 7 | 980° C./48 h + 720° C./8 h + 620° C./8 h | Ar—$H_2$/vacuum | TG |
| 8 | 980° C./39 h + 720° C./8 h + 620° C./8 h | Ar—$H_2$/vacuum | TG or both |
| 9 | 980° C./36 h + 720° C./8 h + 620° C./8 h | Ar—$H_2$ | TG or both |
| 10 | 980° C./33 h + 720° C./8 h + 620° C./8 h | Ar—$H_2$/vacuum | Both |
| 11 | 980° C./30 h + 720° C./8 h + 620° C./8 h | Ar—$H_2$ | Both |
| 12 | 980° C./27 h + 720° C./8 h + 620° C./8 h | Ar—$H_2$ | Both |
| 13 | 990° C./24 h + 720° C./8 h + 620° C./8 h | Ar—$H_2$ | Both |
| 14 | 980° C./240 h + 720° C./8 h + 620° C./8 h | Ar—$H_2$ | Both |
| 15 | 980° C./21 h + 720° C./8 h + 620° C./8 h | Ar—$H_2$/vacuum | Both |
| 16 | 980° C./18 h + 720° C./8 h + 620° C./8 h | Ar—$H_2$/vacuum | Both |
| 17 | 980° C./15 h + 720° C./8 h + 620° C./8 h | Ar—$H_2$/vacuum | Both |
| 18 | 980° C./12 h + 720° C./8 h + 620° C./8 h | Ar—$H_2$ | Both |
| 19 | 980° C./9 h + 720° C./8 h + 620° C./8 h | Ar—$H_2$/vacuum | Both |
| 20 | 980° C./6 h + 720° C./8 h + 620° C./8 h | Ar—$H_2$/vacuum | Both |
| 21 | 980° C./3 h + 720° C./8 h + 620° C./8 h | Ar—$H_2$/vacuum | Both |
| 22 | 980° C./1 h + 720° C./8 h + 620° C./8 h | Ar—$H_2$/vacuum | Both |
| 23 | 980° C./0 h 30 + 720° C./8 h + 620° C./8 h | Ar—$H_2$/vacuum | Both |

The fracture modes were identical for both test conditions.

Testpieces 1 and 2 were not subjected to desensitization treatment and presented fracture surfaces with both brittle intergranular and ductile transgranular features.

Testpieces 3 to 23 which were subjected to such treatment presented:

- either fracture surfaces presenting both fragile intergranular and ductile transgranular features;
- or else fracture surfaces that presented purely ductile transgranular features.

The ductile transgranular nature of the fracture surfaces was more marked when the desensitization treatment was long. From 36 h, some purely transgranular fracture surfaces were found, and beyond 39 h of treatment, the fracture surfaces were always purely transgranular. Treatment durations lying in the range 36 h to 39 h thus lie at the limit for total desensitization of the samples, and under such circumstances, obtaining partial or total desensitization depends on the variability of treatment conditions, such as temperature.

Desensitization treatment at 980° C. for at least 40 h is thus completely effective on those sheets for always obtaining total desensitization of the material to environmentally-assisted cracking in air at 650° C.

The following can be said concerning the effects of the desensitization heat treatment on the microstructure of the material.

When a 718 alloy is treated at 850° C.-1010° C., a δ phase is precipitated in quantities that depend on temperature and on treatment time. The rate of heating also has a major influence on the quantity of δ phase present, particularly at high temperatures, greater than 950° C. For the slower rates of heating, the δ phase can form during heating. Thus, depending on the holding temperature the volume fraction of δ phase tends to increase if the temperature is low, or to decrease and then stabilize if the temperature lies in the upper part of the acceptable range.

Above about 1010° C. (the solvus temperature of the δ phase, which can vary by a few degrees as a function of the exact composition of the alloy), grain growth becomes considerably accentuated, making the microstructure less well adapted for the preferred applications of the invention.

In contrast, in the range 980° C. to 1000° C., with a sufficient holding time and for all possible compositions of a 718 alloy, small intergranular particles of δ phase can be eliminated and the non-soluble precipitates can be spheroidized.

It was also verified that the treatment atmosphere is of capital importance for successful desensitization treatment, by performing comparative tests on samples that had been subjected to treatment for 96 h at 980° C. either in an Ar—$H_2$ (5%) atmosphere, or under a vacuum. It was clearly found that the samples that had been treated under a vacuum fractured during a traction test with brittle intergranular fracture surfaces, whereas those that were treated under a hydrogen-containing atmosphere had ductile transgranular fracture surfaces. The presence of a hydrogen-containing atmosphere, comprising pure $H_2$ or containing at least 100 ppm of $H_2$ mixed with an inert gas such as Ar, is thus indeed essential in the context of the invention.

For the aging treatment that follows desensitization in certain preferred applications of the invention such as grid springs for fuel assemblies, it is usually recommended to perform such treatments at temperatures that do not exceed 760° C. Above that temperature, δ phase precipitation is observed in the form of films or fillets at the grain boundaries associated with a density of γ' and γ" precipitates in the same locations. Consequently, during tests in an autoclave (350° C.) representative of the primary conditions of a PWR, cracking is often found in samples subjected to stresses greater than or equal to the elastic limit of the alloy. According to conventional ideas, the δ phase formed in excess at relatively low temperature is more damaging to sensitivity to environmentally-assisted cracking than is the δ phase that is formed at relatively high temperature (greater than 950° C.) during the desensitization treatment.

Experiments performed by the inventors show that when desensitization to environmentally-assisted cracking treatment is performed (980° C., 40 h) prior to aging (740° C. to 780° C., 8 h, then cooling in the oven), then the sensitivity to environmentally-assisted cracking is eliminated in any event, and the aging performed in that way, in that treatment range, has no detrimental influence on environmentally-assisted cracking. Aging merely performs its usual function of adjusting the mechanical properties of the material. In the present example, aging increases the elastic limit.

A condition that is essential for desensitizing the alloy is that the heat treatment atmosphere is not oxidizing, and better that the atmosphere serves to reduce the oxide layer that is generally naturally present on the surface of the material. Unless an atmosphere of pure hydrogen is used, it is most preferable to perform the desensitization treatment in the presence of a compound that captures the oxygen present with greater affinity than the part being treated.

For this purpose, it is possible to use a metal or some other compound with high oxygen affinity, such as Al, Ti, Hf, Zr, or an alloy including at least a large amount of one such metal, or an element or a compound of elements such as Mg, Ca.

It is possible to cover the surface of the part with a powder of the alloy, but there then exists a risk of the powder sintering and polluting the surface of the part, particularly during lengthier treatments, thus making it difficult to recover the part. Nevertheless, that method has been tested successfully in the context of the present development.

It can therefore be preferable to use two other techniques that have found to be effective and that avoid the risks involved with using powder.

A first technique consists in wrapping the part in a sheet having the composition of the metal or the alloy that acts as an oxygen trap.

A second technique consists in placing the part in a box having one or more walls made of the metal or alloy.

As a preferred, but non-exclusive example of such an alloy, mention can be made of the FeCrAlY alloy used during the above-described desensitization tests. This material, used as an ingredient for catalytic converters in the automobile industry, or as an ingredient of parts for machine tools or for electrical resistors, is commonly available on the market and is found to be very effective.

Tests have also been performed on the sensitivity to environmentally-assisted cracking of grid springs made out of a 718 alloy having the same composition as the above-described traction testpieces. They were tested at 350° C. in the PWR primary medium with a displacement speed of $10^{-7}s^{-1}$ and with the imposed displacement matching the designs under test.

For springs that were subjected to aging treatment only, without prior desensitization to environmentally-assisted cracking, multiple incipient cracks were found on three of the four legs of the spring, with an intergranular fracture surface.

Performing desensitization treatment for 30 h at 990° C. in an Ar—$H_2$ 5% atmosphere prior to the aging provided an improvement, insofar as the incipient cracks for the intergranular fractures were observed on only one leg and were less numerous than in the absence of treatment. However, the desensitization to environmentally-assisted cracking was then not complete.

In contrast, springs which were subjected to desensitization treatment for a duration of 42 h at 990° C. did not present any incipient intergranular cracks. They were thus completely desensitized to environmentally-assisted cracking, which confirmed the above-described experimental results acquired on testpieces.

Other tests were performed on testpieces of 718 alloy of composition very close to those described above, but for which experience shows they are less sensitive to environmentally-assisted cracking, prior to desensitization, than the preceding testpieces, probably because of differences in the amounts of interstitial elements (C, N, and O) present in various batches of strip.

In certain circumstances, it was found that total desensitization to environmentally-assisted cracking could be obtained after 15 h of treatment at 990° C.±10° C. Highly significant but not always total desensitization could always be obtained after 30 h of treatment at 990° C.±10° C. Beyond 40 h of treatment, total desensitization to environmentally-assisted cracking both in air at 650° C. and in PWR primary medium at 350° C. was always obtained.

Under such conditions, the following treatment conditions in accordance with the invention are proposed for desensitization to environmentally-assisted cracking of a nickel-based alloy in general, having the following composition: C≦0.10%; Mn≦0.5%; Si≦0.5%; P≦0.015%; S≦0.015%; Ni≧40%; Cr=12%-40%; Co≦10%; Al≦5%; Mo=0.1%-15%; Ti≦5%; B≦0.01%; Cu≦5%; W=0.1%-15%; Nb=0-10%; Ta≦10%; the balance being Fe and inevitable impurities that result from processing, with 718 alloy constituting a preferred but non-exclusive example thereof and with the heat treatment being as follows.

The atmosphere is constituted either by pure hydrogen, or by an inert gas, such as argon, mixed with at least 100 ppm of hydrogen, the absence of oxygen preferably being guaranteed by the presence, in the environment of the part for treatment, of a compound that presents greater affinity for oxygen than does the Ni-based alloy.

The compound may be a metal such as Al, Zr, Ti, Hf, or an alloy containing at least one of those metals, such as an FeCrAlY alloy, or an element or a compound of a plurality of elements such as Mg or Ca.

At least during the treatment for desensitization to environmentally-assisted cracking, the Ni-based alloy may be wrapped in a sheet of the compound that presents greater affinity for oxygen, carbon, and nitrogen than does the Ni-based alloy.

At least during the treatment for desensitization to environmentally-assisted cracking, the Ni-based alloy may be placed in a box having one or more walls made out of the compound presenting greater affinity for oxygen than the Ni-based alloy.

At least during the treatment for desensitization to environmentally-assisted cracking, the Ni-based alloy may be immersed in a powder of the compound presenting greater affinity for oxygen than the Ni-based alloy.

The precise conditions for the minimum duration and the temperature of the treatment depend on the shape of the products and half-finished products that are to be desensitized, and also on the looked-for quality of the desensitization.

The temperature of the desensitization heat treatment may lie in the range 950° C. to 1160° C. In general, one of the following two ranges is selected: 950° C.-1010° C. or 1010° C.-1160° C.

The duration of the desensitization heat treatment can be determined by using empirical formulae deduced from experiments. For example, for a sheet having a thickness of 0.3 mm and treated at 980° C.-1000° C., the following formula can be used to determine the minimum duration of treatment needed to obtain a product that is totally desensitized:

t (in hours)=3.4×(B %) if the initial brittleness F lies in the range 0 to 10%; and t (in hours)=0.2×(B %) if the initial brittleness B lies in the range 10% to 50%.

The brittleness B of the material is defined herein as being the ratio of the total length of grain boundary fracture zones divided by the total length of the perimeter of the fracture surface, during a test performed in a medium representative of the operating conditions of the component.

The choice of treatment temperature range (950° C.-1010° C. range of 1010° C.-1160° C. range) depends essentially on the stage in the processing of the material at which the treatment is performed and on requirements for the microstructure thereof at the end of treatment.

The higher temperature treatment is preferably performed at the half-finished product stage with subsequent treatments in the processing serving to regenerate the microstructure of the material if it has been unfavorably affected by the desensitization.

The lower temperature treatment is preferably performed at the finished product stage, and thus constitutes the last step of processing, with grain size then generally not being significantly influenced by the desensitization treatment.

Nevertheless, this selection is not limiting: the high temperature treatment can be performed on the finished product when there is no imposed requirement on microstructure, as applies for example to cluster guide pins. Similarly, the lower temperature treatment can be performed on a half-finished product, with treatment that is longer than it would be at high temperature then being necessary to obtain total desensitization, other things remaining equal.

Nevertheless, it may be desirable to reduce the duration of the heat treatment, particularly when it is performed at the half-finished product stage. The resulting half-finished product will still be slightly sensitive to environmentally-assisted cracking at its surface at the end of treatment because of edge effects that lead to a concentration of stabilizing elements at the interface between the metal and the treatment atmosphere. Under such circumstances, in order to obtain a product that is totally desensitized, the heat treatment is finished off by an operation of eliminating the surface layer that has not been totally desensitized.

The surface layer may be eliminated by machining and/or chemical, electrochemical, or mechanical polishing.

The treatment for desensitization to environmentally-assisted cracking applies to the nickel-based alloy may be followed, where necessary, by heat treatment for annealing, recrystallization, solution heat treatment, or hardening (also known as aging treatments) as are conventionally applied by the person skilled in the art when processing half-finished products and products made of nickel-based alloys in order to facilitate subsequent manufacturing operations and end up with the microstructure and the mechanical characteristics that are needed to ensure the components behave well in service. One essential condition is for these heat treatments, if any, to be performed in a non-oxidizing atmosphere so as to avoid resensitizing the material to environmentally-assisted cracking.

The invention makes it possible to obtain parts and half-finished products as given in the following non-exhaustive list.

The part made in this way may be a structural element of a fuel assembly for a nuclear reactor.

The part may then be a grid spring, or a hold-down assembly, or a screw.

The part may be an element of a nuclear reactor cooling circuit.

The part may then be a pipe, a cluster guide pin, a spring, a heat exchanger, a screw or a bolt, or any other component made of nickel-based alloy that comes into contact with the heat-conveying fluid.

A half-finished product may be a sheet, a strip, a wire, a bar, or indeed a blank, e.g. obtained by forging, stamping, casting, or even by sintering, from which parts can be made by various conventional shaping, machining, or cutting methods.

The 718 alloy as treated in this way finds a preferred application in particular in the fabrication of grid springs and hold-down assembly spring components for nuclear reactor fuel assemblies, however it can also be used for making other parts to be used in ways that are compatible with its mechanical properties and that will be exposed in service to an environment that is favorable to the development of environmentally-assisted cracking.

The invention claimed is:

1. A heat treatment method for desensitizing a nickel-based alloy with respect to environmentally-assisted cracking in a nuclear reactor environment, the alloy consisting of the following composition in percentages by weight: C≦0.10%; Mn≦0.5%; Si≦0.5%; P≦0.015%; S≦0.015%; Ni≧40%; Cr=12%-40%; Co≦10%; Al≦5%; Mo=0.1%-15%; Ti≦5%; B≦0.01%; Cu≦5%; W=0.1%-15%; Nb=0-10%; Ta≦10%; the balance being Fe, and inevitable impurities that result from processing, the method comprising:

holding the alloy at a temperature in the range of 950° C. to 1160° C. in an atmosphere of pure hydrogen or containing at least 100 ppm of hydrogen mixed with an inert gas for a duration until the nickel-based alloy is desensitized to environmentally assisted cracking in a nuclear reactor environment, the nickel-based alloy being considered as desensitized to environmentally assisted cracking in a nuclear reactor environment if a fractured surface of the nickel-based alloy is either purely ductile transgranular or both ductile transgranular and intergranular as determined by traction tests performed in air at 650° C. at a speed of $10^{-3}$ $s^{-1}$.

2. The method according to claim 1 wherein the treatment for desensitization to environmentally-assisted cracking is performed at a temperature in the range of 950° C. to 1010° C.

3. The method according to claim 1 wherein the treatment for desensitization to environmentally-assisted cracking is performed at a temperature in the range of 1010° C. to 1160° C.

4. The method according to claim 1 wherein the treatment for desensitization to environmentally-assisted cracking is performed on a half-finished product that is subsequently subjected to a further treatment to modify its metallurgical structure.

5. The method according to claim 4 wherein the further treatment is treatment for annealing, recrystallizing, solution heat treatment, or hardening, performed in a non-oxidizing atmosphere.

6. The method according to claim 1 wherein the treatment for desensitization to environmentally-assisted cracking is performed on a product that is not subsequently subjected to further treatment seeking to modify its metallurgical structure.

7. The method according to claim 1 wherein after the desensitization to environmentally-assisted cracking, the alloy is subjected to at least one of machining and polishing.

8. The method according to claim 1 wherein the treatment for desensitization is performed in the presence of an element, an alloy or a compound presenting greater affinity for oxygen than the nickel-based alloy.

9. The method according to claim 8 wherein the element presenting greater affinity for oxygen than the nickel-based alloy is a metal selected from the group of Al, Zr, Ti, Hf, Mg, Ca, the alloy presenting greater affinity for oxygen than the nickel-based alloy is an alloy containing at least one of Al, Zr, Ti, Hf, and the compound presenting greater affinity for oxygen than the nickel-based alloy includes at least one of Mg and Ca.

10. The method according to claim 9 wherein at least during the treatment for desensitization to environmentally-assisted cracking, the Ni-based alloy is wrapped in a sheet of the metal or alloy or compound presenting greater affinity for oxygen than said Ni-based alloy.

11. The method according to claim 9 wherein at least during the treatment for desensitization to environmentally-assisted cracking, the Ni-based alloy is placed in a box having one or more walls made of the metal or alloy or compound presenting greater affinity for oxygen than the Ni-based alloy.

12. The method according to claim 9 wherein at least during the treatment for desensitization to environmentally-assisted cracking, the Ni-based alloy is placed in a powder of the metal or alloy or compound presenting greater affinity for oxygen than the Ni-based alloy.

13. The method according to claim 1 wherein the duration is at least 40 hours.

14. The method according to claim 1 further comprising performing an aging treatment on the nickel-based alloy after the nickel-based alloy is desensitized to environmentally assisted cracking.

15. The method according to claim 1 wherein the duration is a function of the brittleness of the nickel-based alloy.

16. The method according to claim 1 wherein the alloy is held at a temperature in the range of 950° C. to 1160° C. in an atmosphere of pure hydrogen or containing at least 100 ppm of hydrogen mixed with an inert gas until the nickel-based alloy is desensitized to environmentally assisted cracking experienced in a nuclear reactor.

17. The method according to claim 1 wherein the nickel-based alloy is desensitized when the fractured surface is purely ductile transgranular.

18. A method of fabricating a part out of a nickel-based alloy having the following composition in percentages by weight: C≦0.10%; Mn≦0.5%; Si≦0.5%; P≦0.015%; S≦0.015%; Ni≧40%; Cr=12%-40%; Co≦10%; Al≦5%; Mo=0.1%-15%; Ti≦5%; B≦0.01%; Cu≦5%; W=0.1%-15%; Nb=0-10%; Ta≦10%; the balance being Fe, and inevitable impurities that result from processing, the method comprising:

the holding step recited in claim 1.

19. A heat treatment method for desensitizing a nickel-based alloy with respect to environmentally-assisted cracking in a nuclear reactor environment, the alloy having the following composition in percentages by weight: C≦0.08% ; Mn≦0.35%; Si≦0.35%; P≦0.015%; S≦0.015%; Ni=50%-55%; Cr=17%-21%; Co≦1%; Al=0.2%-0.8%; Mo=2.8%-3.3%; Ti=0.65%-1.15%; B≦0.006%; Cu≦0.3%; Nb+Ta=4.75%-5.5%; the balance being Fe, and inevitable impurities that result from processing, the method comprising:

holding the alloy at a temperature in the range of 950° C. to 1160° C. in an atmosphere of pure hydrogen or containing at least 100 ppm of hydrogen mixed with an inert gas such that the nickel-based alloy is desensitized in a nuclear reactor environment, the nickel-based alloy being desensitized in a nuclear reactor environment if a fractured surface of the nickel-based alloy is either purely ductile transgranular or both ductile transgranular and intergranular as determined by traction tests performed in air at 650° C. at a speed of $10^{-3}$ $s^{-1}$.

20. The method according to claim 19 wherein the nickel-based alloy is desensitized when the fractured surface is purely ductile transgranular.

* * * * *